United States Patent [19]

Decrane

[11] 4,056,132

[45] Nov. 1, 1977

[54] BAG FILLING APPARATUS WITH AIR CONTAMINATE PREVENTION

[75] Inventor: Charles E. Decrane, West Monroe, La.

[73] Assignee: Olinkraft, Inc., West Monroe, La.

[21] Appl. No.: 673,849

[22] Filed: Apr. 5, 1976

[51] Int. Cl.[2] ..... B65B 3/18

[52] U.S. Cl. ..... 141/285; 141/314

[58] Field of Search ..... 141/1, 4–7, 141/10, 52, 53, 59–61, 65, 66, 93, 46, 114, 313–317, 312, 287, 290, 292, 67, 68, 51, 285

[56] References Cited

U.S. PATENT DOCUMENTS 3,149,649 9/1964 Hix ..... 141/315

FOREIGN PATENT DOCUMENTS 266,115 2/1927 United Kingdom ..... 141/93

*Primary Examiner*—Houston S. Bell, Jr.
*Attorney, Agent, or Firm*—O'Brien & Marks

[57] ABSTRACT

A bag filling apparatus has sealing facilities for forming an enclosed chamber around an unclamped portion of the open top of a bag surrounding a filling spout so that contaminates exiting through bulges in the unclamped portion of the top of the bag are prevented from escaping.

10 Claims, 7 Drawing Figures

BAG FILLING APPARATUS WITH AIR CONTAMINATE PREVENTION

BACKGROUND OF THE INVENTION

1. Field of the Invention

The invention relates to apparatus for filling bags, and particularly to apparatus which is adapted to discharge dust producing or volatile materials into the bags without contaminating the air surrounding the bag filling apparatus.

2. Description of the Prior Art

The prior art, as exemplified in U.S. Pat. Nos. 3,698,451, 3,750,721 and 3,830,266, contains a number of apparatus for filling bags. When such prior art apparatus is used to fill bags with powdery or dusty material or volatile materials, air contamination occurs in the air surrounding the bagging apparatus. Sometimes masks were worn by operators in the vicinity of the bag filling apparatus in order to avoid breathing the air contaminates. Also there have been prior attempts to remove contaminated air from the vicinity of the bag filling apparatus or to recapture the contaminant after it has escaped.

SUMMARY OF THE INVENTION

The invention is summarized in an apparatus for filling a bag having an open top including filling spout means adapted to be received in the open top of the bag, clamping means for tightly engaging a portion of the top of the bag against the filling spout means, and sealing means for sealingly engaging the remaining portion of the top of the bag and for sealingly engaging the spout means above the remaining portion of the top of the bag to form enclosed chamber means around the remaining portion of the top of the bag to prevent escape of contaminates.

An object of the invention is to eliminate the escape of air contaminates which pass through the opening between a filling spout and a bag top in a bag filling apparatus.

Another object of the invention is to construct an inexpensive and simple attachment which can be added on a bag filling apparatus to prevent air contamination.

One advantage of the invention is that an enclosed chamber is formed with the bulges of the top of the bag and the spout above the bag to prevent escape of contaminates passing through the bulges.

One feature of the invention is that the openings between clam-shell halves of a filling spout are enclosed together with the top bulges of a bag to avoid air contamination.

Other objects, advantages and features of the invention will be apparent from the following description of the preferred embodiment taken in conjunction with the accompanying drawings.

DESCRIPTION OF THE PREFERRED EMBODIMENT

Figure 1:
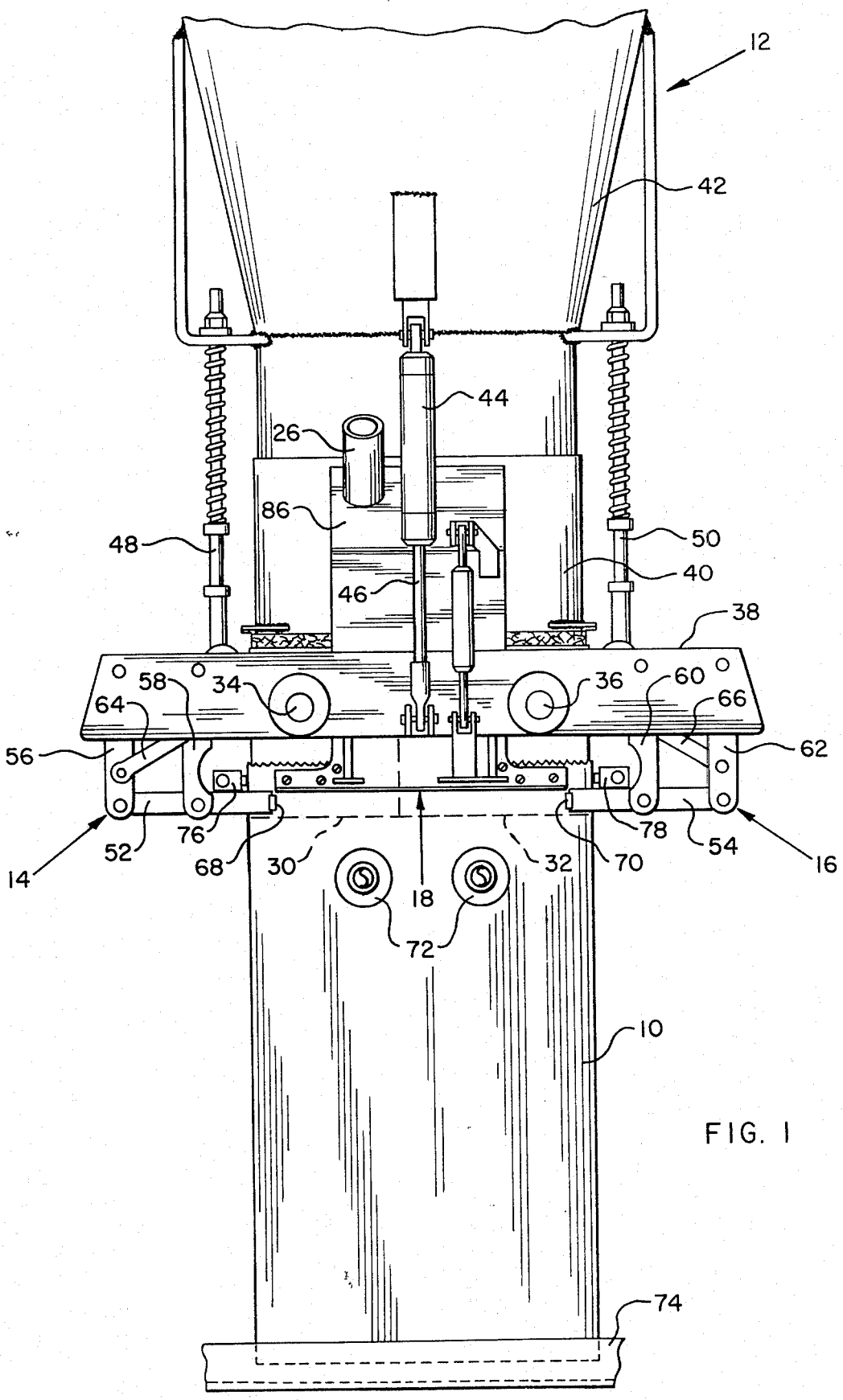
FIG. 1 is a front elevation view of an apparatus in accordance with the invention.

As illustrated in FIG. 1, the invention is embodied in an apparatus for filling bags, such as multiwall paper bags 10, which have open tops. The apparatus includes (a) filling spout means indicated generally at 12, (b) clamping or gripping means indicated generally at 14 and 16 for firmly engaging opposite portions or the sides of the top of the bag 10 against opposite sides of the bottom of the spout means 12, and (c) sealing means indicated generally at 18 and 20, FIG. 2, for sealingly engaging the remaining portions or the front and back of the top of the bag 10 and the outside of the spout means 12 above the front and back of the bag 10. Chambers 22 and 24 enclosing the front and back portions of the top of the bag are formed by the sealing means 18 and 20 to prevent contaminates from bulges in the top of the bag escaping into the air surrounding the apparatus during the filling operation. Evacuation means including tubes 26 and 28 communicate with the chambers 22 and 24 to remove the contaminates.

The bag filling apparatus may be a part of an automatic apparatus which includes a bag opening and transfer mechanism, such as is illustrated in U.S. Pat. No. 3,698,451, together with bag conveying and closing mechanisms, such as are illustrated in U.S. Pat. Nos. 2,755,986, 2,796,300, and 3,875,726. The bag filling apparatus also includes conventional weighing mechanisms (not shown) for discharging predetermined weights of material into the spout means. The spout means 12 and the gripping means 14 and 16 illustrated in the drawings are substantially similar to those described in U.S. Pat. No. 3,830,266; but many other spout means and gripping means in both manual and automatic bag filling apparatus would be suitable.

The spout means 12 includes (a) a pair of clam-shell halves 30 and 32 pivotally mounted by respective pins 34 and 36 on a movable frame 38, (b) a sleeve 40 fixed to the movable frame 38, and (c) a stationary transition chute 42 which has an upper tapered portion communicating with a lower tubular portion telescoped within the movable sleeve 40. A pneumatic or hydraulic cylinder 44 is suitably attached to the stationary chute 42 and has a piston rod 46 attached to the movable frame 38 for raising and lowering the sleeve 40 and the clam-shell halves 30 and 32. Spring biased rods 48 and 50 extend between the stationary transition chute 42 and the clam-shell halves 30 and 32 for pivoting the bottoms of the clam-shell halves 30 and 32 outward when the frame 38 is lowered and for pivoting the bottoms of the clam shells halves inward when the frame 38 is raised.

Figure 7:
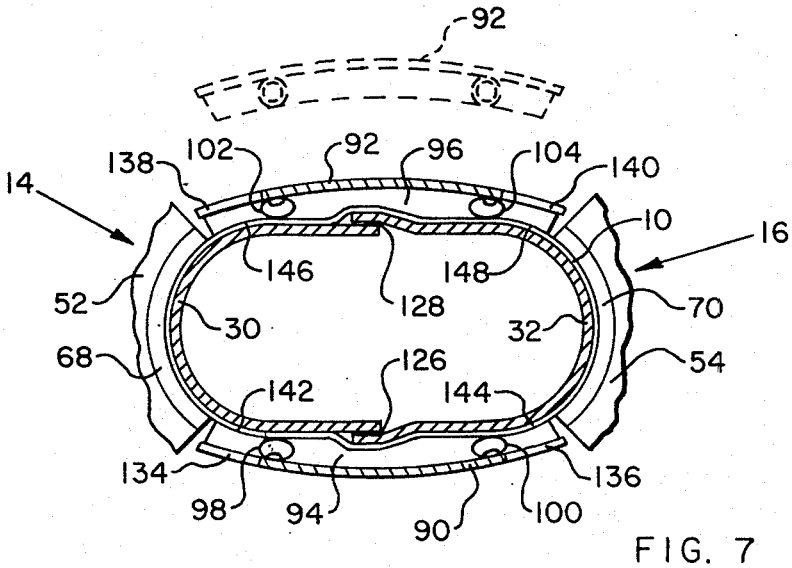
FIG. 7 is a cross section view taken along line 7—7 of FIG. 2.

The gripping means 14 and 16 include respective gripper plates 52 and 54 movably mounted on the bottom ends of parallel bars 56, 58, 60 and 62 which are pivotally attached at their upper ends to the movable frame 38. Linkages 64 and 66 connect the respective parallel bars 56 and 62 to the clam-shell halves 30 and 32 to move the gripper plates 52 and 54 by movement of the clam-shell halves 30 and 32. Resilient pads 68 and 70 are mounted on the ends of the gripper plates 52 and 54 for firmly or tightly engaging opposite side portions of the top of the bag 10 against the outside of the lower ends of the respective clam-shell halves 30 and 32. As shown in FIG. 7, the clam shell halves 30 and 32, when in the open position, form a spout end with an oval cross section which is sufficiently smaller than the bag to allow for normal variations in the size of the bags without tearing the bags. The gripping pads 68 and 70 extend around a substantial portion of the curved ends of the oval cross section of the spout bottom. The transfer mechanism includes suction cups 72, FIG. 1, for slightly raising the bag 10 above a dead plate 74 prior to the lowering of the frame 38 and the clamping of the gripping means 14 and 16 to allow for expansion of the bag 10 during filling.

Bag sensing means, such as sensors 76 and 78 mounted on the gripper plates 52 and 54 for cooperating with openings 80 and 82 in the clam shell halves 30 and 32 to sense the presence of the bag similar to the sensors described in U.S. Pat. Nos. 3,750,721 and 3,830,266, is also provided.

The sealing means 18 and 20 as illustrated in FIGS. 1, 2, 3, and 7 include respective housings 86 and 88 sealingly attached to the front and back of the sleeve 40 to form the upper portions of the chambers 22 and 24. The evacuation tubes 26 and 28 are mounted to the housing 86 and 88. The lower portions of the chambers 22 and 24 are formed by a pair of plate members 90 and 92 which have respective horizontal extending elongated resilient members or seals 94 and 96 and pairs of spaced vertical elongated resilient members or seals 98, 100, 102 and 104. The plates 90 and 92 are pivotally mounted at their upper ends on respective front and back portions 106 and 108 of the movable frame 38 (FIG. 1). Arms 110 and 112 extend rigidly from the lower ends of the plates 90 and 92 and have their distal ends pivotally connected to respective piston rods 114 and 116 which extend from pneumatic or hydraulic cylinders 118 and 120 pivotally mounted on brackets 122 and 124 fixed on the housings 86 and 88. Conventional control facilities operated by the sensors 76 and 78 operate the cylinders 118 and 120 to close the plates 90 and 92 against the bag 10 simultaneously with the release of the material from the weighing mechanism; the plates 90 and 92 are opened simultaneously with the opening of the clamping means 14 and 16 and the raising of the frame 38.

Figure 2:
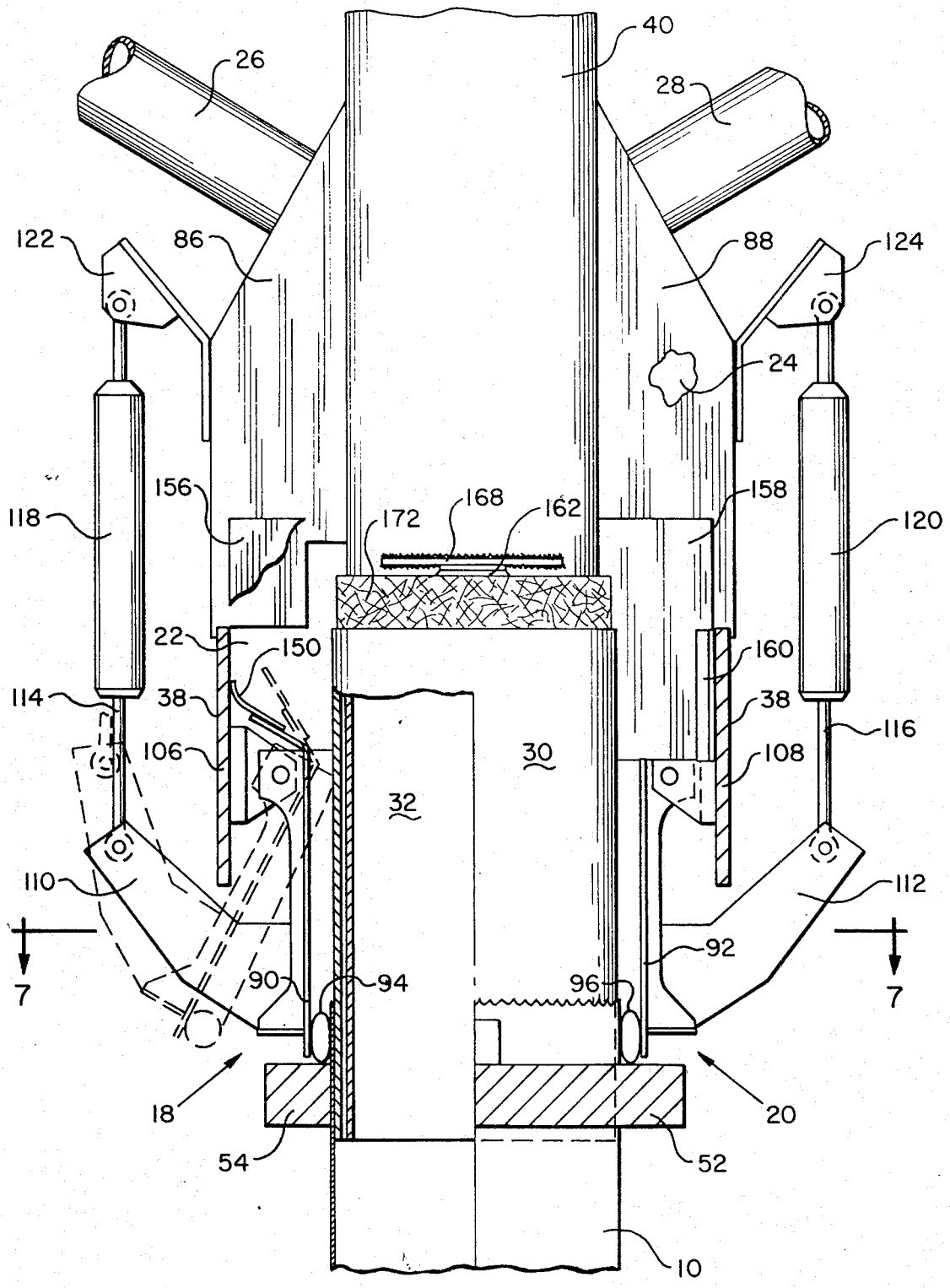
FIG. 2 is a side elevation view with parts broken away of the apparatus of FIG. 1.
Figure 3:
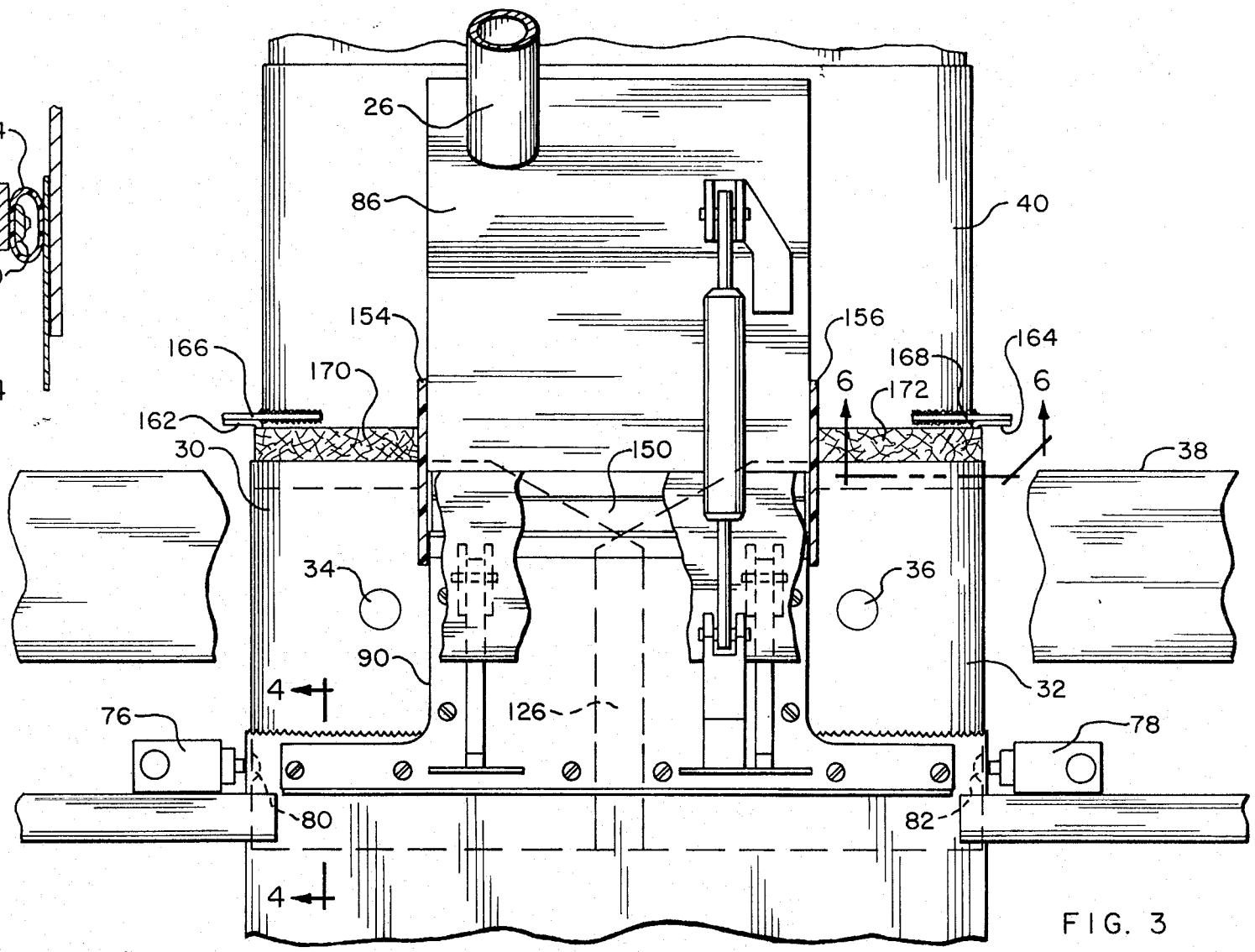
FIG. 3 is an enlarged front elevation view with parts broken away of the apparatus of FIG. 1.
Figure 4:
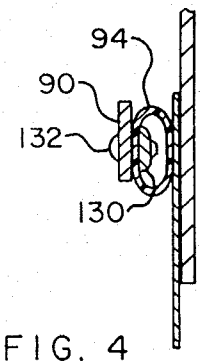
FIG. 4 is a cross section view taken along line 4—4 of FIG. 3.
Figure 5:
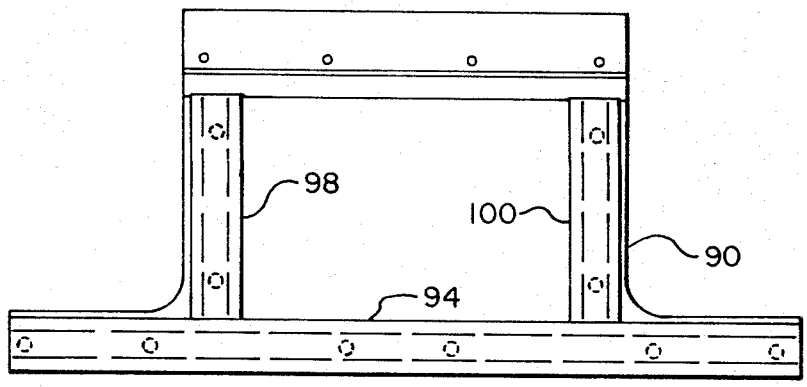
FIG. 5 is a plan view of a movable sealing member of the apparatus of FIG. 1.

As shown in FIG. 5 the central portion of the seal 94 and the vertical seals 98 and 100 are arranged to form a U-shaped seal which has a lower portion 94 for engaging the top of the bag 10 between the gripper means 14 and 16 on the front of the spout means 12, and has the portions 98 and 100 extending upward over the clam-shell halves 30 and 32 on opposite sides of the front seam or opening 126, FIGS. 3 and 7, between the clam-shell halves 30 and 32. Similarly as shown in FIG. 7, the central portion of the seal 96 and the vertically extending seals 102 and 104 form a U-shaped seal which engages the top of the bag 10 on the back of the spout means between the gripping means 14 and 16 and extends up on opposite sides of the back opening 128 between the clam shell halves 30 and 32. The seals 94 and 96, and 98, 100, 102 and 104 are formed from a very flexible material, such as surgical tubing, which is attached by bars 130 secured by screws 132, as illustrated in FIG. 4 for the plate member 90. The plate members 90 and 92 as shown in FIG. 7 are formed with a slight curvature and have wings 134, 136, 138 and 140 supporting extended ends of the respective horizontal seals 94 and 96. The curvature of the members 90 and 92 is selected to engage the seals 94 and 96 on the extending wings 134, 136, 138 and 140 first at tangent points 142, 144, 146 and 148 on the bag 10 adjacent the clamping means 14 and 16. The tangent points 142, 144, 146 and 148 are located in an area where the stiffness of the bag walls results in the bag 10 sealingly engaging the outside of the clam shell halves 30 and 32 from the clamping pads 68 and 70 into the areas between the vertical seals 98, 100, 102 and 104 on the front and back. The flexibility of the seals 94 and 96 together with the curvature of the members 90 and 92 are also selected to allow the bag 10 to bulge away from substantially straight front and back sections of the clam shell halves 30 and 32 adjacent the openings 126 and 128. The force applied by the cylinders 118 and 120, FIG. 2, is selected to avoid placing sharp creases in the bag 10 but sufficient to produce a light seal with the bag 10.

As shown in FIGS. 2 and 3, a strip-like seal 150 is secured on an outwardly and upwardly directed upper end of the plate member 90 so as to engage the inside of the front member 106, sealed with the housing 86, when the plate member 90 is closed against the bag 10. A similar seal member (not shown) is mounted on the upper end of plate member 92 for engaging the inside surface of the back member 108. Flexible skirt members 154 and 156 are attached to the opposite sides of the housing 86 and extend downward over the sides of the upper ends of the plate member 90 and seals 98 and 100 as well as against the front side of the clam-shell halves 30 and 32 to complete the enclosure of the chamber 22 while allowing movement of the clam-shells 30 and 32 and the plate member 90. Similar flexible skirt members (only one skirt 158 is shown) on the sides of the housing 88 complete the sealing of the bottom of the housing 88 with the top of the plate member 92 and seals 102 and 104. Securing members 160 (only one of four shown) on the front and back frame portions 106 and 108 secure the bottom portion of the skirts 154, 156 and 158.

Figure 6:
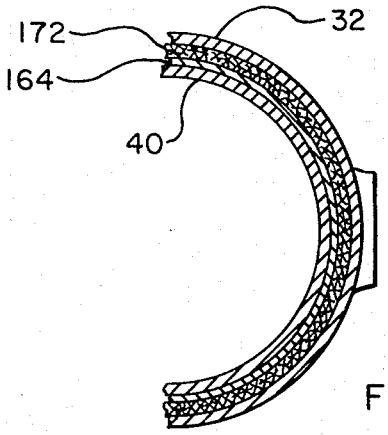
FIG. 6 is a cross section view taken along line 6—6 of FIG. 3.

As shown in FIGS. 2, 3, and 6 a pair of semi-circular members 162 and 164 are mounted on tabs 166 and 168 welded to the outside of the sleeve 40 to tightly conform to the outer surface of rounded sides of the sleeve 40 exposed outside the front and rear housings 86 and 88. A flexible resilient sealing material such as felt 170 and 172 is mounted on the outer surface of the members 162 and 164 to seal the upper ends of the clam-shell halves 30 and 32 when the clam-shell halves are in the open position as shown in FIG. 3.

In operation of the apparatus for filling bags shown in FIG. 1, the clam-shells 30 and 32 pivot from an inward position to an outward position within the top of the bag 10 while the gripper plates 52 and 54 move inwardly to firmly clamp or engage the opposite side portions of the top of the bag 10 against the opposite sides of the spout formed by the clam-shell halves 30 and 32. The presence of a bag is sensed by sensing devices 76 and 78 and the air cylinders 118 and 120 are operated to pivot the plate members 90 and 92 from raised positions (see phantom position of 90 in FIG. 2) to lowered positions for sealingly engaging front and back portions of the top of the bag between the clamping means 14 and 16. Also plate members 90 and 92 and seals 98, 100, 102 and 104 sealingly engage the clam-shell halves 30 and 32. Enclosed chambers 22 and 24 are thus formed around the bulges in the top portions of the bag 10 between the clamping means 14 and 16 and around the front and back openings 126 and 128 between the clam shell halves 30 and 32. The evacuation means through the tubes 26 and 28 maintains a partial vacuum within the chambers 22 and 24 preventing escape into the atmosphere of contaminates from the bulges in the top of the bag and from the openings between the clam shell halves 30 and 32. The clamp means 14 and 16 prevent any escape of contaminates from the bag in the areas where the bag is clamped by the clamping means to the spout.

The seals 94 and 96 engaging the oval spout formed by the clam-shell halves 30 and 32 at the tangental points 142, 144, 146 and 148 insures that the bag 10 in the areas adjacent the clamping means 14 and 16 does not bulge away from the spout and allow leakage of the contaminates to the atmosphere. Further the curvatures of the plate members 90 and 92 allow for lesser engaging forces between the central portions of the seal members 94 and 96 and the bag 10 to allow some bulging of the bag 10 without causing sharp creases therein. Sharp creases formed in the bag 10 could interfere with later closing of the top of the bag by automatic equipment as well as possible producing a weakness which could result in rupture of the bag.

Since many modifications, variations and changes in detail may be made to the described embodiment, it is intended that all matter in the foregoing description and shown in the accompanying drawings be interpreted as illustrative and not in a limiting sense.

What is claimed is:

1. An apparatus for filling a bag having an open top, comprising in combination:

filling spout means adapted to be received in the open top of the bag, clamping means for tightly engaging a portion of the top of the bag against the filling spout means, sealing means for sealingly engaging the remaining portion of the top of the bag, said sealing means defining a portion of an enclosed chamber means disposed for sealingly containing the spout means externally above the remaining portion of the top of the bag to prevent escape of contaminates.

2. An apparatus as claimed in claim 1 wherein the clamping means includes a pair of clamps for engaging opposite portions of the top of the bag on opposite sides of the spout means, and the sealing means includes a pair of members having respective U-shaped seals thereon for engaging the tops of the bags on the front and back of the spout means between the pair of clamps wherein the bottoms of the U-shaped seals engage the bag while the upward extending portions of the U-shaped seals extend onto the spout means above the top of the bag.

3. An apparatus as claimed in claim 2 wherein the pair of members are pivotally mounted; and there is included means for sensing a bag secured by the clamps to the spout means, and means responsive to the sensing means for pivoting the pair of members to engage the seals with the bag and the spout means.

4. An apparatus as claimed in claim 2 wherein the U-shaped seals are such that they engage the bag and the spout means at side edges thereof before and with greater force than in a center portion to allow the bag to bulge without being creased.

5. An apparatus as claimed in claim 4 wherein the spout means is oval and has front and back sections which are substantially straight, the pair of members are curved to engage the respective front and back straight sections of the spout means and the bag at tangential points on the sides of the front and back sections while the bottoms of the seal members engage the bag across the straight sections of the spout means.

6. An apparatus as claimed in claim 5 wherein the pair of members include wing portions extending from opposite sides of the bottom of the U-shaped seal to secure the bag to the spout means adjacent the pair of clamps.

7. An apparatus as claimed in claim 6 wherein the spout means includes a pair of clam shell halves which are pivoted to allow easy insertion in the top of the bag when the clam shell halves are closed and to hold the top of the bag open when the clam shell halves are open, the U-shaped seals enclosing the openings between the clam shell halves.

8. An apparatus as claimed in claim 2 wherein the sealing means includes a pair of housings sealingly mounted on the front and back of the spout means, said housing having open bottoms receiving the tops of the respective pair of members, and top seal means for sealing the top of the pair of members with the respective housings.

9. An apparatus as claimed in claim 8 wherein the pair of members are pivotally mounted, the top seal means includes a pair of flexible seal portions on the top of the respective pair of members and extending above the pivot points of the pair of members for being pivoted into sealing engagement with the respective housings, and flexible skirts mounted on the housing and slidably engaging the side portions of the top of the pair of members and seals.

10. An apparatus as claimed in claim 9 including evacuating means communicating with the enclosed chamber means formed by the sealing means.

* * * * *